US006196546B1

(12) United States Patent
Iglesias

(10) Patent No.: US 6,196,546 B1
(45) Date of Patent: Mar. 6, 2001

(54) CHESS GAME APPARATUS

(76) Inventor: Andrew V. Iglesias, 54 N. Blandford Rd., Blandford, MA (US) 01008

( * ) Notice: Subject to any disclaimer, the term of this patent is extended or adjusted under 35 U.S.C. 154(b) by 0 days.

(21) Appl. No.: 09/310,616

(22) Filed: May 12, 1999

Related U.S. Application Data

(60) Provisional application No. 60/086,122, filed on May 20, 1998.

(51) Int. Cl.[7] ..... A63F 3/00

(52) U.S. Cl. ..... 273/285; 273/287; D21/335; 206/315.1

(58) Field of Search ..... 273/236, 285, 273/286, 287; D21/334, 335, 343, 348; 206/315.1

(56) References Cited

U.S. PATENT DOCUMENTS

| | | | |
|---|---|---|---|
| D. 296,909 | * | 7/1988 | Lin . |
| D. 300,399 | * | 3/1989 | Krugman . |
| D. 330,805 | * | 11/1992 | Yang . |
| 538,380 | | 4/1895 | McKenzie . |
| 724,760 | | 4/1903 | Van Altena . |
| 1,793,256 | * | 2/1931 | Shulman . |
| 4,781,384 | | 11/1988 | Bois . |
| 5,280,913 | | 1/1994 | Sirk . |
| 5,497,998 | | 3/1996 | Horton . |
| 5,845,780 | * | 12/1998 | Allen . |

* cited by examiner

*Primary Examiner*—Benjamin H. Layno
*Assistant Examiner*—Vishu Mendiratta

(57) ABSTRACT

A chess game apparatus provides a chess board in an unrolled condition and an octagonal storage device for chess pieces in a rolled up condition. The chess game apparatus includes a first end board/storage unit which includes a first outside surface which includes a set of eight alternating dark and light squares and which includes four interior storage compartments. A first end hinge is connected to a rear portion of the first end board/storage unit. A set of six intermediate board/storage units are connected to the first end hinge. Five intermediate hinges are provided between rear portions of the six intermediate board/storage units. Each of the intermediate board/storage units includes an outside surface which includes a set of eight alternating dark and light squares. Also each of the intermediate board/storage units includes four interior storage compartments. A second end hinge is connected to a rear portion of one of the intermediate board/storage units. A second end board/storage unit is connected to the second end hinge and includes a second outside surface which includes a set of eight alternating dark and light squares, and the second end board/storage unit includes four interior storage compartments. A set of thirty-two chess pieces can be stored in the thirty-two interior storage compartments of the board/storage units, and the alternating dark and light squares of the storage units provide a sixty-four square chess board when the apparatus is in an unrolled condition.

10 Claims, 3 Drawing Sheets

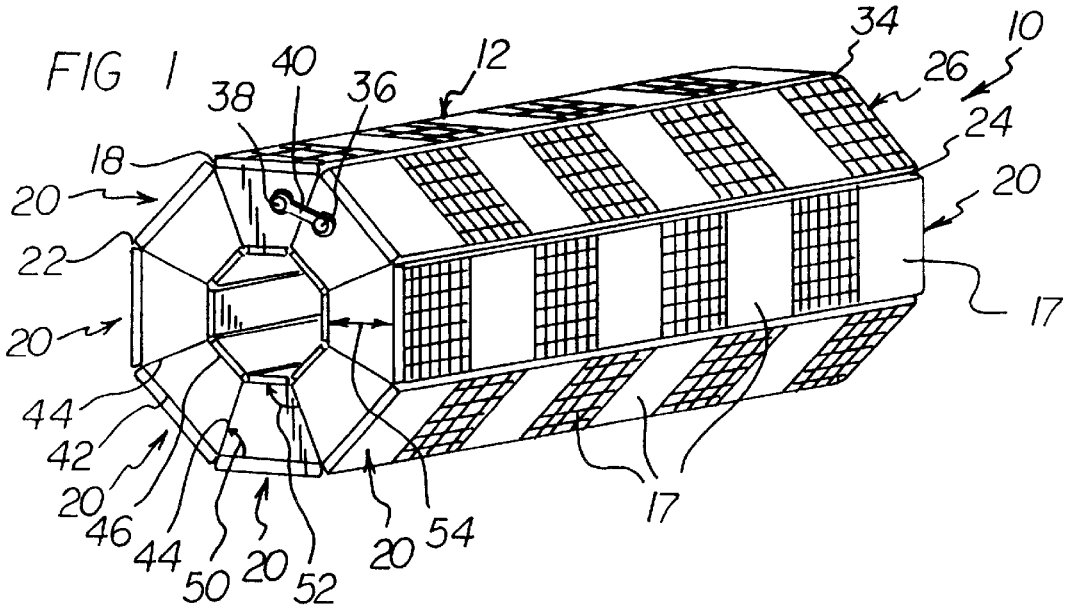
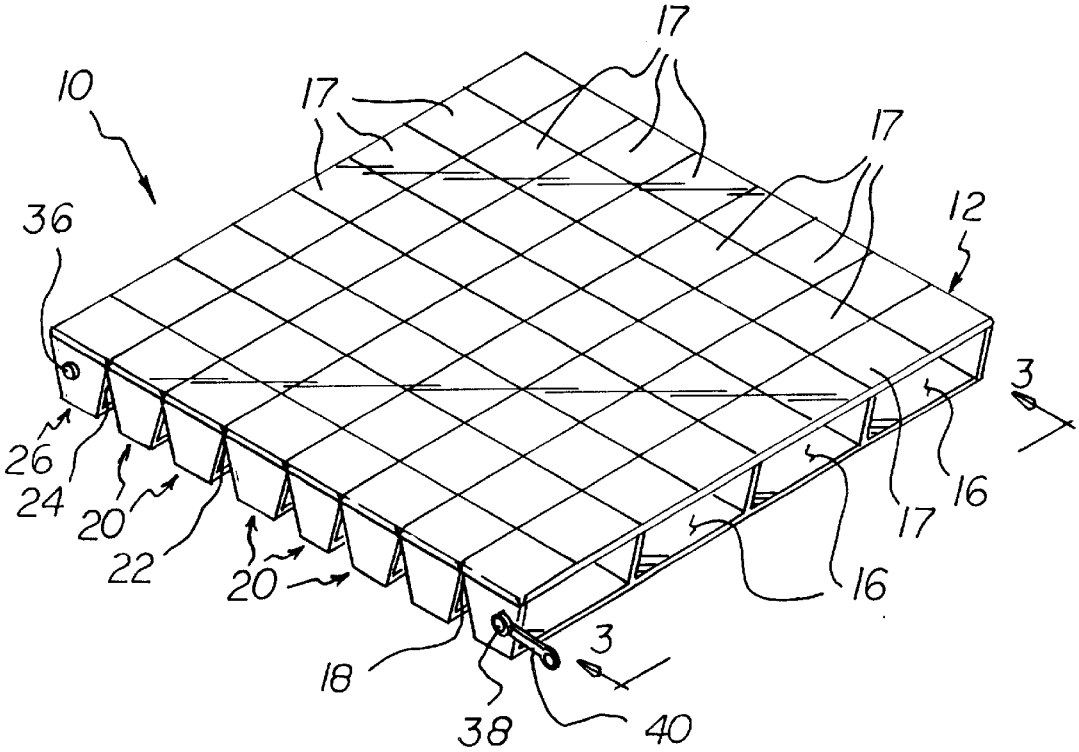
FIG 2

CHESS GAME APPARATUS

CROSS-REFERENCE TO RELATED APPLICATION

This application claims priority based upon my prior copending Provisional Application Ser. No. 60/086,122, filed May 20, 1998.

BACKGROUND OF THE INVENTION

1. Field of the Invention

The present invention relates generally to the game of chess and, more particularly, to chess game boards that can be folded up when not in use.

2. Description of the Prior Art

The game of chess is very popular game and has been so for many years. Often persons like to transport the game to various locations where they would like to play the game. In this respect, throughout the years, a number of innovations have been developed relating to the portability of chess games, and the following U.S. patents are representative of some of those innovations: 538,380, 724,760, 4,781,384, 5,280,913, and 5,497,998. More specifically, each of U.S. Pat. Nos. 538,380 and 5,497,998 discloses a chess board that is capable of being rolled up for transportation. Of course when a chess game is transported, both the board and the pieces must be transported. However, neither U.S. Pat. No. 538,380 nor U.S. Pat. No. 5,497,998 discloses a provision for the transport of the chess pieces. In this respect, it would be desirable if a chess game apparatus were provided which facilitates transportation of both the chess board and the chess pieces.

Each of U.S. Pat. Nos. 724,760 and 4,781,384 discloses a chess game which includes a game board that folds up for easy transport. In addition, each of these patents provides a single storage box container for housing the chess pieces when the game is being transported. However, when such a single chess piece retention container is employed, the chess pieces that are stored will bump up against one another during transport. Some chess pieces are from sets of highly crafted and expensive pieces. When such pieces bump up against one another during transport, some of those pieces may suffer damage. This being the case, it would be desirable if a chess game apparatus were provided that has a storage area for chess pieces that prevents chess pieces from bumping up against one another during transport.

U.S. Pat. No. 5,280,913 discloses a chess game apparatus that has a case that folds up for transport. In addition, individual storage locations are provided for individual chess pieces. It is noted, however, that the overall shape of the apparatus in the storage and transport mode is that of a rectangular box. Such a box-shaped device may not fit easily into a storage compartment that has dimensions that are more adapted to a cylindrical shape. In this respect, it would be desirable if a chess game apparatus were provided which stores individual chess pieces individually and has an overall cylindrical shape when the apparatus is in a storage mode.

Thus, while the foregoing body of prior art indicates it to be well known to use chess games that have folding boards in which chess pieces are stored for transport, the prior art described above does not teach or suggest a chess game apparatus which has the following combination of desirable features: (1) facilitates transportation of both the chess board and the chess pieces together; (2) has a storage area for chess pieces that prevents chess pieces from bumping up against one another during transport; and (3) which stores individual chess pieces individually and has an overall cylindrical shape when the apparatus is in a storage mode. The foregoing desired characteristics are provided by the unique chess game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a chess game apparatus in which a chess board is provided when the apparatus is in an unrolled condition and in which an octagonal storage device is provided when the apparatus is in a rolled up condition. The chess game apparatus includes a first end board/storage unit which includes a first outside surface which includes a set of eight alternating dark and light squares. The first end board/storage unit also includes four interior storage compartments. A first end hinge is connected to a rear portion of the first end board/storage unit. A set of six intermediate board/storage units are connected to the first end hinge. Five intermediate hinges are provided between rear portions of the six intermediate board/storage units. Each of the intermediate board/storage units includes an outside surface which includes a set of eight alternating dark and light squares. Also each of the intermediate board/storage units includes four interior storage compartments. A second end hinge is connected to a rear portion of one of the intermediate board/storage units. A second end board/storage unit is connected to the second end hinge. The second end board/storage unit includes a second outside surface which includes a set of eight alternating dark and light squares, and the second end board/storage unit includes four interior storage compartments. A locking device is connected between the first end board/storage unit and the second end board/storage unit. Each of said first end hinge, the intermediate hinges, and the second end hinge can be in a form of a living plastic hinge.

A set of thirty-two chess pieces can be stored in the thirty-two interior storage compartments of the first end board/storage unit, the six intermediate board/storage units, and the second end board/storage unit. The alternating dark and light squares of the first end board/storage unit, the six intermediate board/storage units, and the second end board/storage unit provide a sixty-four square chess board when the apparatus is in an unrolled condition.

The locking device includes a first locking device member connected to the first end board/storage unit, a second locking device member connected to the second end board/storage unit, and a locking latch connected between the first locking device member and the second locking device member when the apparatus is in a rolled up condition.

Each of the first end board/storage unit, the six intermediate board/storage units, and the second end board/storage unit includes trapezoidal end walls each of which includes a base edge, a pair of side edges extending upward from the base edge, and a top edge connected between the side edges. Each of the trapezoidal end walls has a trapezoidal height. For each trapezoidal end wall, a base-edge-to-side-edge angle is approximately sixty-seven and one half degrees and a side-edge-to-top-edge angle is approximately one hundred twelve and one half degrees. As a result, when the chess game apparatus is in a rolled up condition, the apparatus is rolled up into an eight-sided, octagonal structure.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved chess game apparatus which has all of the advantages of the prior art and none of the disadvantages.

It is another object of the present invention to provide a new and improved chess game apparatus which may be easily aid efficiently manufactured and marketed.

It is a further object of the present invention to provide a new and improved chess game apparatus which is of durable and reliable construction.

An even further object of the present invention is to provide a new and improved chess game apparatus which is susceptible of a low cost of manufacture with regard to both materials and labor, and which accordingly is then susceptible of low prices of sale to the consuming public, thereby making such chess game apparatus available to the buying public.

Still yet a further object of the present invention is to provide a new and improved chess game apparatus which facilitates transportation of both the chess board and the chess pieces together.

Still another object of the present invention is to provide a new and improved chess game apparatus that has a storage area for chess pieces that prevents chess pieces from bumping up against one another during transport.

Yet another object of the present invention is to provide a new and improved chess game apparatus which stores individual chess pieces individually and has an overall cylindrical shape when the apparatus is in a storage mode.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the chess game apparatus of the invention in a rolled up condition.

FIG. 2 is a perspective view showing the embodiment of the invention shown in FIG. 1 in an unrolled condition.

DESCRIPTION OF THE PREFERRED EMBODIMENT

Figure 3:
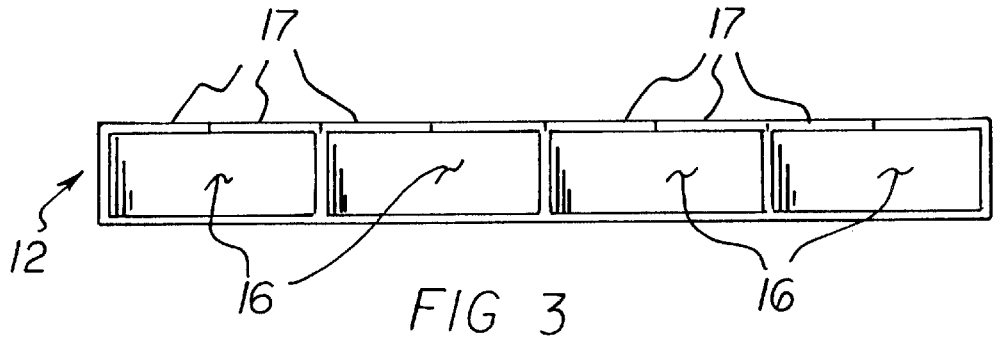
FIG. 3 is an enlarged edge view of the embodiment of the invention shown in FIG. 2 taken along line 3—3 thereof.

With reference to the drawings, a new and improved chess game apparatus embodying the principles and concepts of the present invention will be described.

Turning to FIGS. 1–6, there is shown an exemplary embodiment of the chess game apparatus of the invention generally designated by reference numeral 10. In its preferred form, chess game apparatus 10 includes a first end board/storage unit 12 which includes a first outside surface which includes a set of eight alternating dark and light squares 17. The first end board/storage unit 12 also includes four interior storage compartments 16. A first end hinge 18 is connected to a rear portion of the first end board/storage unit 12. A set of six intermediate board/storage units 20 are connected to the first end hinge 18. Five intermediate hinges 22 are provided between rear portions of the six intermediate board/storage units 20, Each of the intermediate board/storage units 20 includes an outside surface which includes a set of eight alternating dark and light squares 17. Also each of the intermediate board/storage units 20 includes four interior storage compartments 16. A second end hinge 24 is connected to a rear portion of one of the intermediate board/storage units 20. A second end board/storage unit 26 is connected to the second end hinge 24. The second end board/storage unit 26 includes a second outside surface which includes a set of eight alternating dark and light squares 17, and the second end board/storage unit 26 includes four interior storage compartments 16. A locking device is connected between the first end board/storage unit 12 and the second end board/storage unit 26. Each of said first end hinge 18, the intermediate hinges 22, and the second end hinge 24 can be in a form of a living plastic hinge.

A set of thirty-two chess pieces can be stored in the thirty-two interior storage compartments 16 of the first end board/storage unit 12, the six intermediate board/storage units 20, and the second end board/storage unit 26. The alternating dark and light squares 17 of the first end board/storage unit 12, the six intermediate board/storage units 20, and the second end board/storage unit 26 provide a sixty-four square chess board when the apparatus is in an unrolled condition.

The locking device includes a first locking device member 36 connected to the first end board/storage unit 12, a second locking device member 38 connected to the second end board/storage unit 26, and a locking latch 40 connected between the first locking device member 36 and the second locking device member 38 when the apparatus is in a rolled up condition. If desired, a second such locking device (not shown) may conveniently be suitably affixed to the opposite side of the apparatus (i.e. right-most side as viewed in FIGS. 1 and 2).

Each of the first end board/storage unit 12, the six intermediate board/storage units 20, and the second end board/storage unit 26 includes trapezoidal end walls each of which includes a base edge 42, a pair of side edges 44 extending upward from the base edge 42, and a top edge 46 connected between the side edges 44. Each of the trapezoidal end walls has a trapezoidal height 54. For each trapezoidal end wall, a base-edge-to-side-edge angle 50 is approximately sixty-seven and one half degrees and a side-edge-to-top-edge angle 52 is approximately one hundred twelve and one half degrees. As a result, when the chess game apparatus 10 is in a rolled up condition, the apparatus is rolled up into an eight-sided, octagonal structure.

The chess game apparatus 10 of the invention can be used in two different modes an octagonal storage and carrying mode as shown in FIG. 1, and a game playing mode as shown in FIG. 2. With respect to the game playing mode, chess pieces (not shown) are removed from the interior storage compartments 16. The unrolled apparatus is placed on a flat surface, and the alternating dark and light squares 17 on the outside surfaces of the first end board/storage unit 12, the six intermediate board/storage units 20, and the second end board/storage unit 26 form a sixty-four square chess board has alternating dark and light squares 17.

Figure 4:
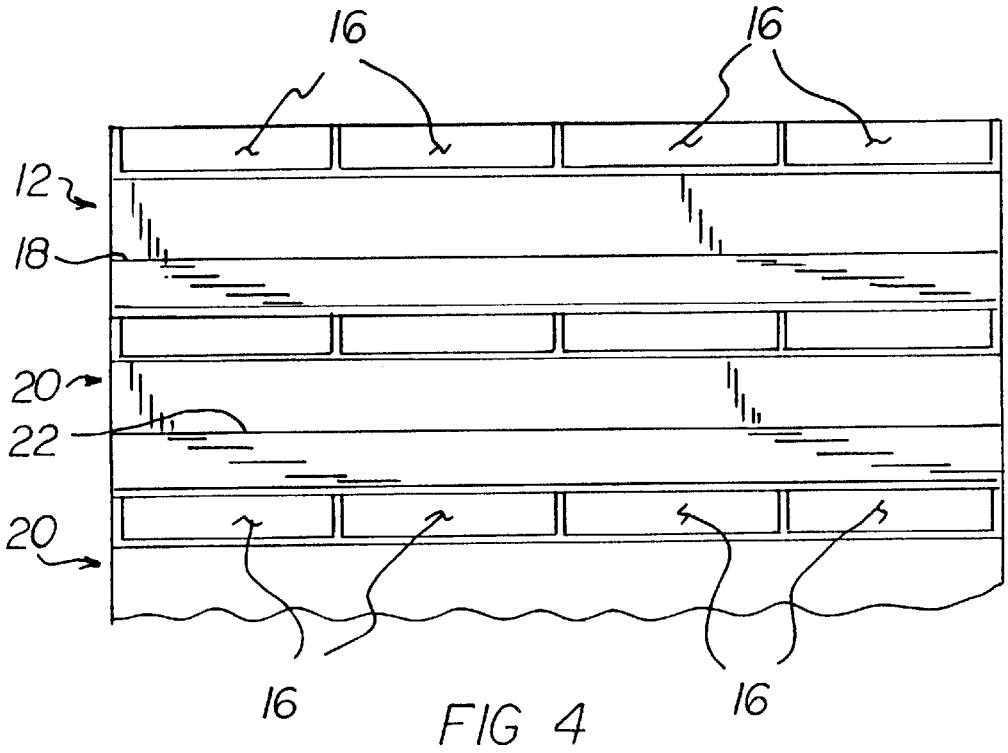
FIG. 4 is an enlarged bottom view of a portion of the embodiment of the invention shown in FIG. 2.
Figure 5:
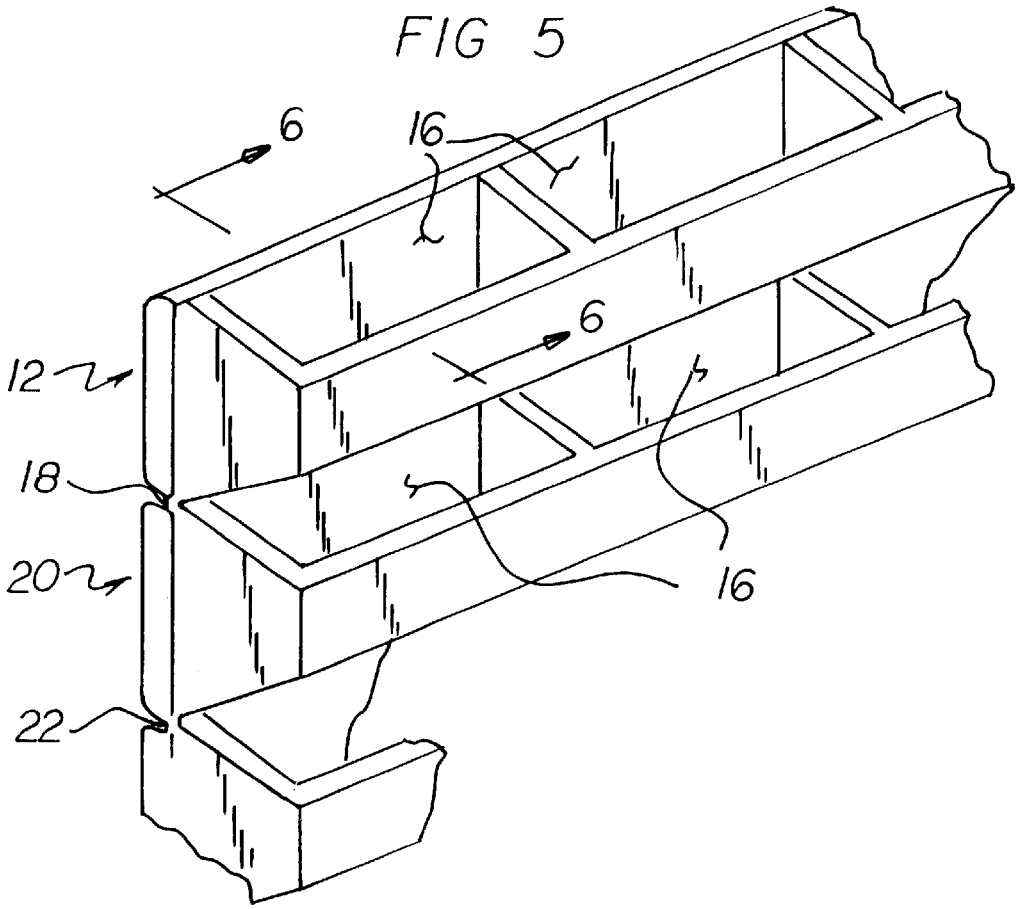
FIG. 5 is a perspective view of the embodiment of the invention shown in FIG. 4.
Figure 6:
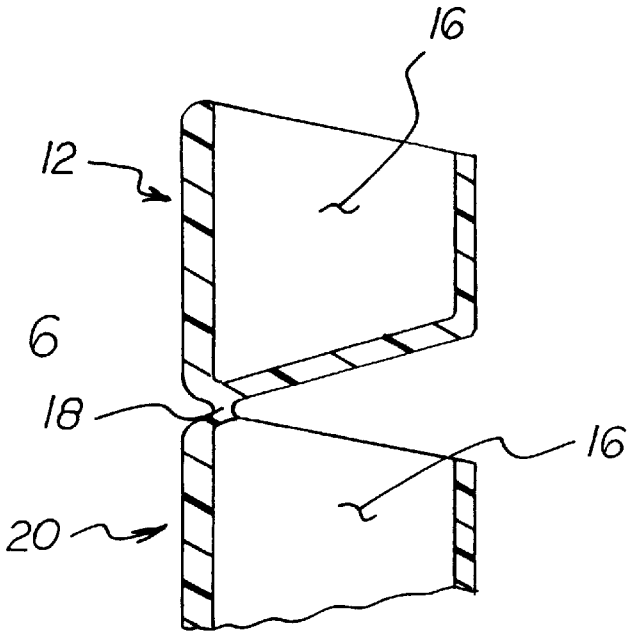
FIG. 6 is an enlarged cross-sectional view of the portion of the embodiment of the invention shown in FIG. 5 taken along line 6—6 thereof.

When the chess game has been completed and it is desired to store the game, the unrolled apparatus is turned over so that the open ends of the interior storage compartments 16 face upward, as shown in FIG. 4. Then, the thirty-two chess pieces are placed in the thirty-two interior storage compartments 16 that are provided. Then, the chess game apparatus 10 is rolled up into the storage mode shown in FIG. 1. To do so, the first end board/storage unit 12 is rotated around the first end hinge 18 so that side portions of the first end board/storage unit 12 press up against side portions of the first of the intermediate board/storage units 20. Then, the intermediate board/storage units 20 are rolled up around the intermediate hinges 22. Finally, the intermediate board/storage units 20 are rolled up around the second end hinge 24 so that one side of the first end board/storage unit 12 is placed against one side of the second end board/storage unit 26, shown at reference numeral 34 in FIG. 1. Then, the locking latch 40 can be locked onto the second locking device member 38 so that the chess game apparatus 10 remains in the rolled up condition until unlocked and unrolled.

The components of the chess game apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved chess game apparatus that is low in cost, relatively simple in design and operation, and which may advantageously be used to facilitate transportation of both the chess board and the chess pieces together. With the invention, a chess game apparatus is provided which has a storage area for chess pieces that prevents chess pieces from bumping up against one another during transport. With the invention, a chess game apparatus is provided which stores individual chess pieces individually and has an overall cylindrical shape when the apparatus is in a storage mode.

While the present invention contemplates an apparatus especially designed to accommodate chess pieces, it will be appreciated that other game pieces may be accommodated as well. For example, the pieces used in the game of checkers might be substituted or used with the chess pieces described above. Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the united states is as follows:

1. A game apparatus, comprising:

a first end board/storage unit which includes a first outside surface which includes a set of eight alternating dark and light squares, and wherein said first end board/storage unit includes four interior storage compartments, a first end hinge connected to a rear portion of said first end board/storage unit, a set of six intermediate board/storage units connected to said first end hinge, wherein five intermediate hinges are provided between rear portions of said six intermediate board/storage units, wherein each of said intermediate board/storage units includes an outside surface which includes a set of eight alternating dark and light squares, and wherein each of said intermediate board/storage units includes four interior storage compartments, a second end hinge connected to a rear portion of one of said intermediate board/storage units, a second end board/storage unit connected to said second end hinge, wherein said second end board/storage unit includes a second outside surface which includes a set of eight alternating dark and light squares, and wherein said second end board/storage unit includes four interior storage compartments, and at least one locking device connected between said first end board/storage unit and said second end board/storage unit.

2. The apparatus of claim 1 wherein each of said first end hinge, said intermediate hinges, and said second end hinge can be in a form of a living plastic hinge.

3. The apparatus of claim 1, further including:

a set of at least thirty-two game pieces which can be stored in said thirty-two interior storage compartments of said first end board/storage unit, said six intermediate board/storage units, and said second end board/storage unit.

4. The apparatus of claim 3, further including:

wherein said game pieces are chess pieces.

5. The apparatus of claim 1 wherein said alternating dark and light squares of said first end board/storage unit, said six intermediate board/storage units, and said second end board/storage unit provide a sixty-four square chess board when said apparatus is in an unrolled condition.

6. The apparatus of claim 1 wherein said at least one locking device includes:

a first locking device member connected to said first end board/storage unit, a second locking device member connected to said second end board/storage unit, and a locking latch connected between said first locking device member and said second locking device member when said apparatus is in a rolled up condition.

7. The apparatus of claim 1 wherein each of said first end board/storage unit, said six intermediate board/storage units, and said second end board/storage unit includes trapezoidal end walls, each of which includes a base edge, a pair of side edges extending upward from said base edge, and a top edge connected between said side edges.

8. The apparatus of claim 7 wherein each of said trapezoidal end walls has a trapezoidal height.

9. The apparatus of claim 8 wherein a base-edge-to-side-edge angle is approximately sixty-seven and one half degrees.

10. The apparatus of claim 8 wherein a side-edge-to-top-edge angle is approximately one hundred twelve and one half degrees.

* * * * *